United States Patent [19]

Ichida et al.

[11] 4,190,469

[45] Feb. 26, 1980

[54] METHOD FOR FORMING FORSTERITE INSULATING FILM ON AN ORIENTED SILICON STEEL SHEET

[75] Inventors: Toshio Ichida; Michiro Komatsubara, both of Chiba; Hiroshi Shimanaka, Funabashi, all of Japan

[73] Assignee: Kawasaki Steel Corporation, Tokyo, Japan

[21] Appl. No.: 956,912

[22] Filed: Nov. 2, 1978

[30] Foreign Application Priority Data

Nov. 9, 1977 [JP] Japan ..... 52-133543

[51] Int. Cl.[2] ..... H01F 1/04

[52] U.S. Cl. ..... 148/113; 148/12.1; 148/13.1; 148/27; 148/31.5

[58] Field of Search ..... 148/113, 12.1, 13.1, 148/27, 31.5; 427/127

[56] References Cited

U.S. PATENT DOCUMENTS

| | | | |
|---|---|---|---|
| 2,906,645 | 9/1959 | Carpenter et al. | 148/113 |
| 3,583,887 | 6/1971 | Steger et al. | 148/113 |
| 3,676,227 | 7/1972 | Matsumoto et al. | 148/113 |
| 4,037,019 | 7/1977 | Steger | 148/113 |

*Primary Examiner*—L. Dewayne Rutledge
*Assistant Examiner*—John P. Sheehan

[57] ABSTRACT

Forsterite insulating films having a high adhesion on an oriented silicon steel sheet are formed by a method wherein an annealing separator consisting mainly of magnesia is applied on surfaces of the oriented silicon steel sheet and the steel sheet is wound up into a coil-form and then annealed at high temperatures to form forsterite insulating films, which is characterized by that the content of water carried into the coil together with the annealing separator is controlled depending upon the content of CaO component carried into the coil together with the annealing separator.

3 Claims, 4 Drawing Figures

METHOD FOR FORMING FORSTERITE INSULATING FILM ON AN ORIENTED SILICON STEEL SHEET

Figure 1:
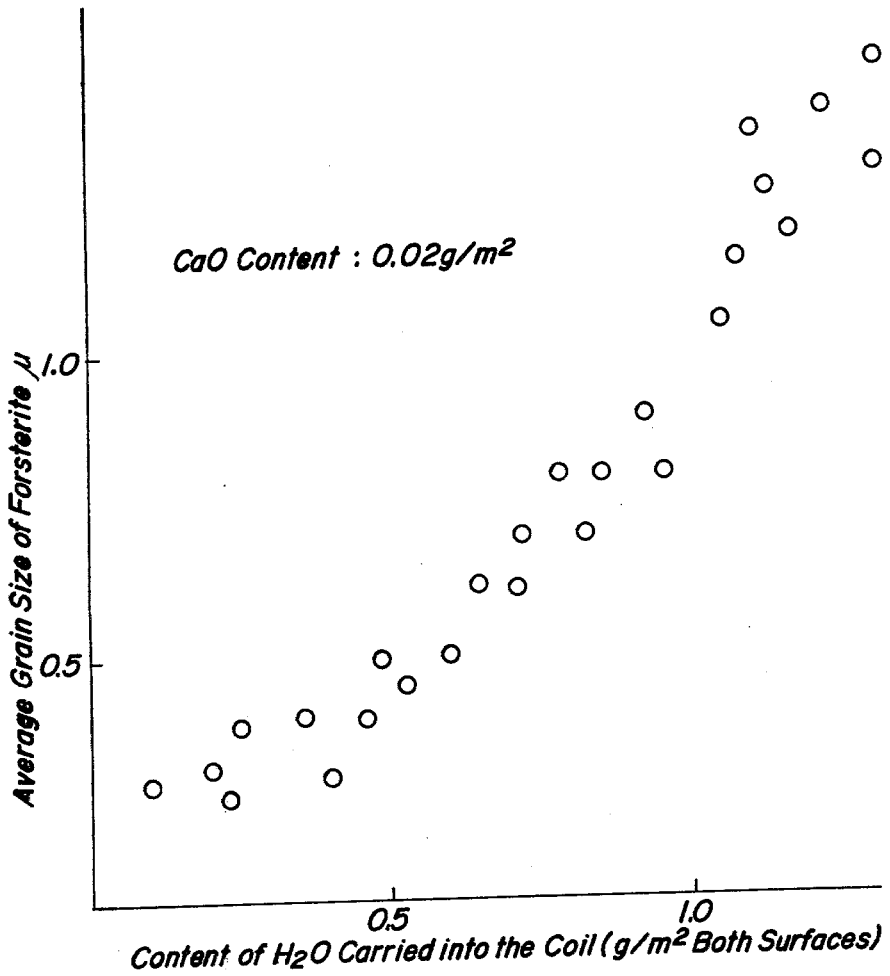

The present invention relates to a method for forming forsterite insulating films on an oriented silicon steel sheet.

As a method for forming insulating films on an oriented silicon steel sheet, the method wherein a silicon steel strip cold rolled into the desired final gauge is decarburized within the temperature range of 700°-900° C. in a wet hydrogen to form subscales containing $SiO_2$ on the surfaces of the steel strip and then an annealing separator consisting mainly of MgO is applied thereon and the thus treated steel strip is wound up into a coil-form and then subjected to the final annealing at high temperatures to form $MgO-SiO_2$ insulating film, has been generally carried out.

It has been known that MgO which is the main component of the above described annealing separator, noticeably influences on the properties of forsterite insulating films formed after final annealing at high temperatures and a large number of studies concerning this matter have been made. For example, Japanese Patent Application Publication No. 14,162/70 has proposed to use magnesia containing at least 70% of magnesia having a grain size of less than 3$\mu$ obtained by baking magnesium hydroxide having the content of impurities of less than 0.2% at two stages of low temperature and high temperature. Japanese Pat. No. 757,433 has proposed that a mixture of a suspension of heavy magnesia which is slow in the hydration rate with a suspension of light magnesia previously completely hydrated in hot water, is applied.

Other than the above described proposals, a large number of proposals concerning the annealing separator have been made and the respective effect is more or less recognized in many proposals, but in order to commercially produce the annealing separators in a large scale, the cost becomes high and in many cases the process control is complicated and difficult. In addition, there are many factors which have influence on the formation behavior of the forsterite insulating film, so that there is wide distribution in the obtained results and the constant result is not obtained and the appearance is nonuniform, the adhesion and the insulation are poor and the formation of the product which is commercially unavailable can not be completely avoided.

An object of the present invention is to provide a method for forming forsterite insulating films wherein the various defects observed in the conventional forsterite insulating films of oriented silicon steel sheets are obviated and improved.

The present invention consists in a method for forming forsterite insulating films having a high adhesion on an oriented silicon steel sheet in which an annealing separator consisting mainly of magnesia is applied on surfaces of an oriented silicon steel sheet, the coated sheet is wound up in a coil-form and subjected to annealing at high temperatures to form forsterite insulating films, characterized in that an amount of water carried into the coil is controlled depending upon an amount of CaO carried into the coil together with the annealing separator.

Then, the present invention will be explained in more detail.

The inventors have observed the micro-structure of the forsterite films obtained by various methods by means of an electromicroscope and found that the good film does not expose the base iron face on the surface and the forsterite grains constituting the forsterite film are fine and when the average grain size is not more than about 0.7$\mu$, the appearance of the coating is good, the uniformity is good, and the bending adhesion and the insulation are excellent and the inventors have made experiment with respect to the method for forming the films and the fine structure of the obtained forsterite films and as the result found that when the dew point of atmosphere between coil layers during the final annealing process is high, the growth of forsterite grains occurs and the bending adhesion and the property of the obtained forsterite film are considerably deteriorated and filed a process wherein the dew point of atmosphere between coil layers during the final annealing is adjusted within the appropriate range, in Japanese Patent application No. 79,720/76.

Thereafter, the inventors have made the further examination with respect to the fine structure of the good forsterite insulating films and found that when the average grain size of forsterite grains constituting the forsterite film is made to be not more than 0.7$\mu$ in not only oriented silicon steel having a high magnetic induction but also conventional oriented silicon steel, the good film property can be obtained.

The inventors have made numerous experiments for obtaining the concrete measure in order to obtain forsterite film having a high adhesion composed of forsterite grains of fine average grain size and a large number of experiments have been made especially with respect to the final annealing process.

As the result, it has been newly found that the grain size of forsterite is greatly influenced by the water content carried into the coil as the hydrate, which was not removed in the steps of applying and drying of the annealing separator consisting mainly of MgO, which are carried out prior to the final annealing after the decarburization annealing and by the amount of CaO component contained and carried into the annealing separator and found that it is important for making forsterite grains constituting the forsterite insulating film obtained after the final annealing fine and for obtaining the good film property, to limit the carried water content depending upon the CaO content, and the present invention has been accomplished.

In general, in the final annealing process of the oriented silicon steel sheet, a slurry of the annealing separator consisting mainly of MgO is applied on a steel strip with a breadth of 700–1,000 mm and dried and then the steel strip is wound up in a coil-form and annealed. This annealing separator is partially converted into magnesium hydroxide during preparing the annealing separator into a slurry, so that water in the form of hydrate remains in the annealing separator even after the drying step after separator coating, and is decomposed during annealing at high temperatures to discharge water vapor. The amount of water carried into the coil in the form of hydrate is determined by various factors, such as the kind of magnesia to be used, the temperature of the annealing separator slurry, the suspended period of MgO in the slurry, the amount of the annealing separator applied, the drying process after separator coating and the like. For example, even if the same magnesia is used, the amount of water carried into the coil is not constant. However, it has been found as the result of the preliminary experiment that the microstructure of forsterite film is greatly influenced by the carried water content and when the amount of water carried is small, the steel sheet surface is covered by fine forsterite grains but if the carried water content increases, the grain size increases and if said content further increases, the surface is not covered by forsterite grains and the base iron surface is partially exposed and as the amount of water of the hydrate increases, the rate of the exposed iron surface increases.

FIG. 1 shows the result obtained by examining the grain size of forsterite formed after the final annealing by using the same magnesia and varying the slurry temperature, the applied amount, the drying condition and the like to vary the water content carried into the coil. MgO used herein is one obtained by baking particularly purified magnesium hydroxide in order to avoid the influence of the contained impurities to the micro-structure of the film. The result of the chemical analysis of MgO used is shown in the following Table 1.

Table 1

| | Analyzed component | | | | | | | | | | |
|---|---|---|---|---|---|---|---|---|---|---|---|
| | $Fe_2O_3$ | $Al_2O_3$ | CaO | $SO_3$ | $SiO_2$ | C | B | Cl | Na | K | P |
| Analyzed value wt % | 0.05 | 0.04 | 0.15 | 0.08 | 0.15 | 0.12 | 0.08 | 0.01 | 0.01 | 0.01 | 0.01 |

As seen from this result, as the water content carried into the coil in the form of hydrate of the annealing separator increases, the grain size of the forsterite crystals constituting the insulating film obtained by the final annealing becomes larger. In order to obtain the grain size of forsterite of not more than 0.7$\mu$ necessary for forming the insulating film having a high adhesion, it is necessary to keep the amount of water carried not more than about 0.7 g/m$^2$ (both surfaces) and in this experiment, the adhesion of the forsterite film obtained in this range was excellent. When the amount of water carried exceeds 1.2 g/m$^2$ (both surfaces), the surfaces are not completely covered with forsterite crystals and the parts where the base iron surface is exposed, appear.

Figure 2:
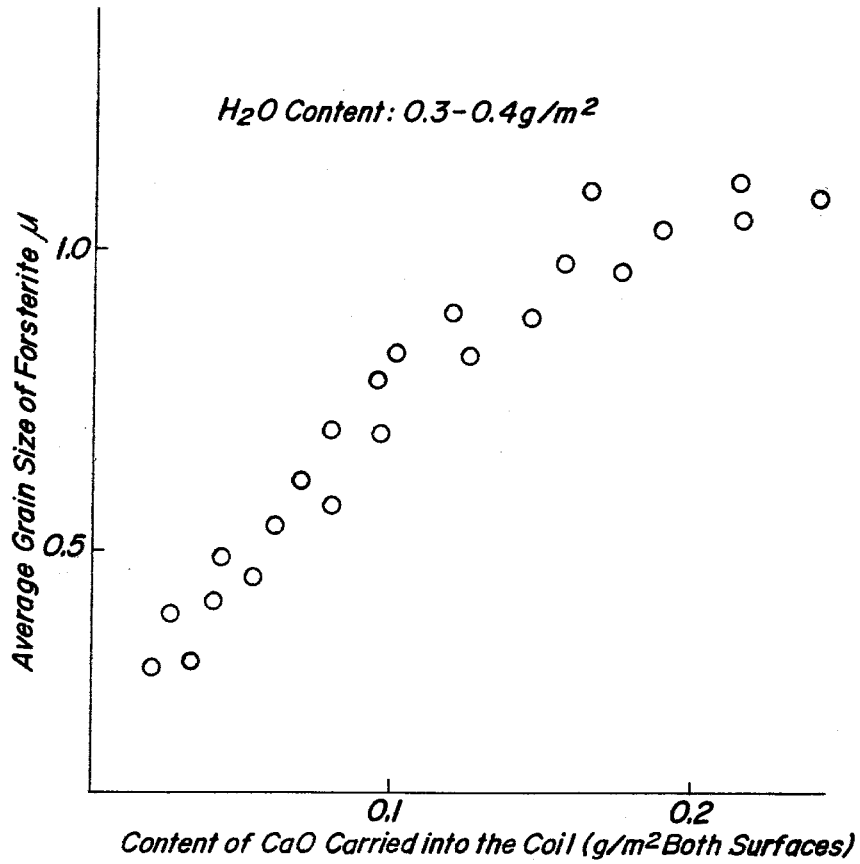

It has been known from the above described experiment that water in the annealing separator causes growth of the forsterite grains but an examination was made with respect to various impurities in MgO as the other factors. MgO is produced by baking magnesium hydroxide or basic magnesium carbonate obtained from marine water and minerals and usually contains $Fe_2O_3$, $Al_2O_3$, CaO, $SO_3$, C, $SiO_2$, B, Cl, Na, K, P and the like inevitably. However, according to the experimental result carried out by varying the amount of these impurities, when $Fe_2O_3$ is less than 1%, $Al_2O_3$ is less than 3%, $SO_3$ is less than 1.5%, C is less than 0.8%, $SiO_2$ is less than 1.5%, B is less than 0.5%, Cl is less than 0.3%, Na is less than 0.2% and K is less than 0.2%, even if the contents of the above described impurities are more or less varied, such contents did not influence upon the grain size of the forsterite crystals. However, it has been found that the CaO content in MgO very greatly influences upon the grain size of forsterite crystals of the obtained film. In FIG. 2, the result of the experiment for forming the film carried out by using various MgO is plotted by the relation of the CaO content contained in the annealing separator and carried into the coil to the grain size of the forsterite crystals constituting the formed surface film. In this Figure, only the result when the amount of water carried into the coil in the form of the hydrate of the annealing separator is 0.3–0.4 g/m$^2$, is shown herein.

As being apparent from the result of FIG. 2, it can be seen that the amount of CaO component contained in the annealing separator and carried into the coil very greatly influences upon the grain growth of the forsterite crystals and in order to obtain the forsterite film composed of the fine grains of not more than 0.7$\mu$, the content of CaO component must be not more than 0.08 g/m$^2$ (both surfaces).

As mentioned above, it has been found from the result of experiment that when the water content carried together with the annealing separator is not more than 0.7 g/m$^2$ (both surfaces) and the amount of CaO component is not more than 0.08 g/m$^2$ (both surfaces), the grain size of the forsterite crystals constituting the formed forsterite film is not more than 0.7$\mu$ and both the adhesion and appearance are excellent. Thus, both the water content and CaO content greatly influence upon the grain growth of the forsterite crystals, so that a further investigation was made with respect to the effect of coexistence of water and CaO.

Figure 3:
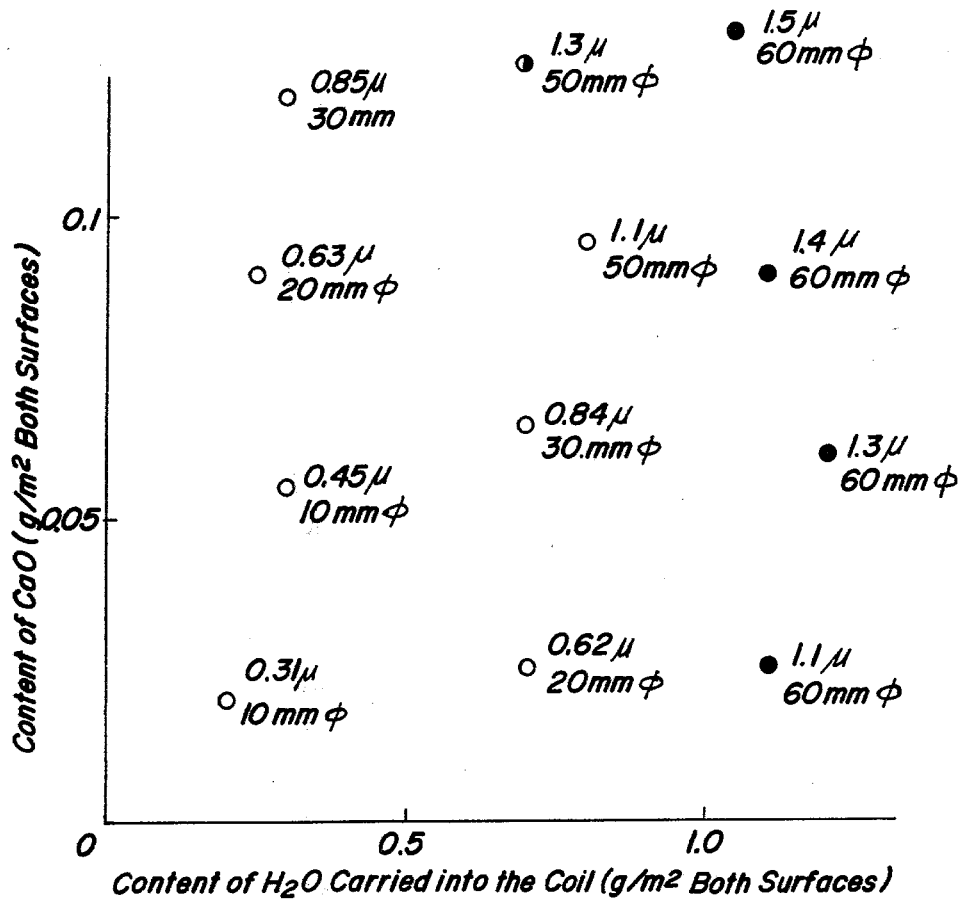

Firstly, an examination was made with respect to what kind of surface film can be obtained when both the amounts of water and CaO carried into the coil by the annealing separator vary. That is, with respect to the films obtained by preparing four kinds of magnesium hydroxide containing different amounts of CaO, baking the four kinds of magnesium hydroxide by varying the baking temperature to prepare various magnesia having different hydrates, suspending the magnesia in water, applying or decarburized sheets in an amount of 13–15 g/m$^2$ (both surfaces), winding up the dried coated steel sheets into coils and subjecting the coiled steel sheets to the final annealing, the forsterite grain size and the bending adhesion were determined. Furthermore, the appearance of the steel sheets obtained by applying a phosphate coating on the forsterite films was observed. The obtained results are shown in FIG. 3. In FIG. 3, the symbol ○ shows the grey uniform appearance, the symbol ● shows the reddish brown appearance all over the surface and the symbol ◑ shows the partially reddish brown appearance and the upper numerals described beside the above described symbols show the average grain size $\mu$ of the obtained forsterite crystals and the lower numerals show the minimum bending diameter mm$\phi$ not exfoliating the insulating film.

The minimum bending diameter not exfoliating the insulating film is used as the indication showing the bending adhesion of the coating and the method for measuring the bending adhesion is as follows. When silicon steel sheets are bent around steel rods having diameters of 10, 20, 30, 40, 50 and 60 mm in 180°, whether the coating of inside of the silicon steel sheet is exfoliated or not is examined and the minimum bending diameter not exfoliating the insulating film is shown by the minimum diameter when the exfoliation of the coating is not caused.

As the coating having the high adhesion in which the coating is not exfoliated even if the coated steel sheet is used as a coiled core and upon slitting, the exfoliation of the coating at the slit edge is not caused, the minimum bending diameter not exfoliating the insulating film must be not more than 20 mmϕ but in order to accomplish this object, the amounts of both components of water and CaO contained in the annealing separator are mutually influenced. The presence of a certain amount of CaO in MgO is inevitable in view of the production hysteresis and the reduction is difficult in view of the production cost and when the amount of hydration water of MgO is too small and the activity is too low, there is problem in the separator coating operation and the chemical reactivity and there is naturally limitation in the decrease of hydration water. It can be seen from the result of FIG. 3 that when the amount of the carried water is small, the amount of CaO tolerated tends to become relatively larger. This is a very practically important information.

Figure 4:
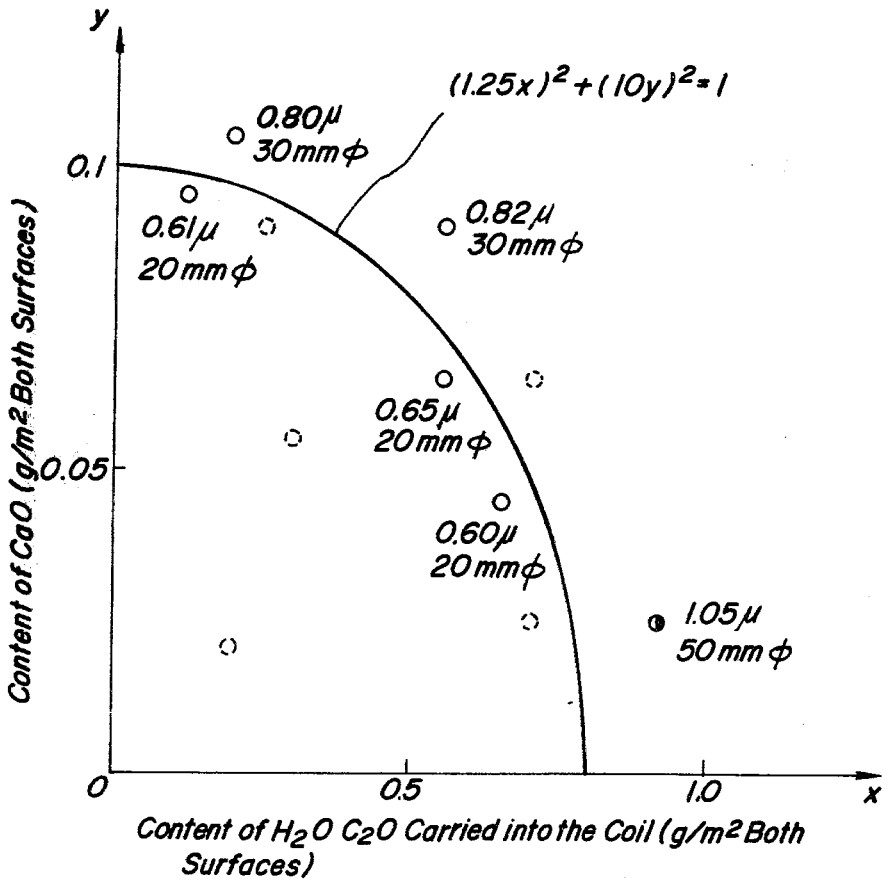

In order to determine the tolerable range of the carried water and CaO in the correlative relation of CaO and water, an experiment again was carried out with respect to the part considered to be the boundary zone of the good range in FIG. 3. The result is shown in FIG. 4. The symbols and the numerals in FIG. 4 were shown in the same manner as in FIG. 3.

From the combination of FIG. 3 and FIG. 4, the appropriate amounts of water and CaO of the annealing separator forming the forsterite film wherein the average grain size of the forsterite crystals constituting the film is not more than 0.7μ, the minimum bending diameter not exfoliating the insulating film is not more than 20 mmϕ and the appearance of the product finally obtained through applying and baking of a phosphate coating is uniformly grey, have been found. If the amounts of water and CaO contained in the annealing separator after separator coating and drying are X(g)/1 $m^2$ of steel sheet (both surfaces) Y(g)/1 $m^2$ of steel sheet (both surfaces) respectively, this range is $(1.25X)^2+(10Y)^2 \leqq 1$.

Both water and CaO in the annealing separator solely have the function to grow the forsterite grains but when both water and CaO coexist, the influence of both the components is more emphasized. Therefore, the tolerable amounts of water and CaO in the annealing separator to form the good forsterite film vary while having the mutual relation and by selecting the contents of both the components so as to satisfy the above formula, the forsterite film composed of fine grains can be obtained by using MgO containing a relatively high concentration of CaO or MgO containing a relatively large content of water.

The present invention will be explained in more detail.

For a better understanding of the invention, reference is taken to the accompanying drawings, wherein FIG. 1 is a view showing the relation of the water content in the annealing separator to the average grain size of the obtained forsterite crystals;

FIG. 2 is a view showing the relation of CaO content in the annealing separator to the average grain size of the obtained forsterite crystals; and FIGS. 3 and 4 are views showing the relations of the contents of water and CaO in the annealing separator to the average grain size (μ) of the obtained forsterite crystals and the minimum bending diameter not exfoliating the insulating film.

The following examples are given for the purpose of illustration of this invention and are not intended as limitations thereof.

EXAMPLE

A silicon steel strip having a thickness of 0.3 mm, a breadth of 970 mm and a length of 3,500 m and containing 0.025% of C, 3.2% of Si and 0.02% of S was continuously annealed at 820° C. for 2.4 minutes at a dew point of 60° C. under gas atmosphere consisting of 70% of $H_2$ and the remainder being $N_2$, magnesia was applied thereon and the dried steel strip was wound up into a coil. The resulting coil was charged in an electric annealing furnace and heated by raising the temperature at a rate of 20° C./hr and annealed at 1,200° C. for 20 hours and then cooled in the furnace.

In the applying of the annealing separator, by using 0.15%–0.9% of CaO and varying the suspending period (10 minutes–24 hours) from preparing magnesia slurry having a temperature of 5° C.–30° C. to coating and the amount (10–15 g/$m^2$) of magnesia applied, the results as shown in Table 2 was obtained.

Table 2

| No. | Amount of annealing separator applied g/$m^2$ (both surfaces) | Content in annealing separator g/$m^2$ both surfaces) Water | CaO | Appearance of obtained forsterite film | Bending adhesion, minimum bending diameter not exfoliating the insulating film (mmϕ) | Inter-laminar resistance Ωcm²/sheet | Average grain size of forsterite crystals (μ) | Appearance after phosphate coating | Remarks |
|---|---|---|---|---|---|---|---|---|---|
| 1 | 13 | 0.31 | 0.020 | Deep grey, uniform | 10 | 24 | 0.31 | Glassy grey, uniform | Present invention |
| 2 | 12 | 1.0 | 0.018 | Tempered color, see through grain of base iron | 50 | 1.4 | 1.1 | Whole reddish brown appearance | Comparative example |
| 3 | 13 | 0.33 | 0.065 | Deep grey, uniform | 10 | 21 | 0.45 | Glassy grey, uniform | Present invention |
| 4 | 13 | 0.95 | 0.065 | Grey, uniform | 40 | 1.8 | 1.2 | Partially reddish brown, nonuniform | Comparative example |
| 5 | 10 | 0.20 | 0.090 | D grey, uniform | 20 | 18 | 0.60 | Glassy grey, uniform | Present invention |
| | | | | | | | | Partially | |

Table 2-continued

| No. | Amount of annealing separator applied g/m² (both surfaces) | Content in annealing separator g/m² both surfaces) Water | CaO | Appearance of obtained forsterite film | Bending adhesion, minimum bending diameter not exfoliating the insulating film (mmϕ) | Inter-laminar resistance Ωcm²/sheet | Average grain size of forsterite crystals (μ) | Appearance after phosphate coating | Remarks |
|---|---|---|---|---|---|---|---|---|---|
| 6 | 15 | 0.86 | 0.14 | Grey, uniform | 50 | 1.2 | 1.2 | reddish grey, nonuniform | Comparative example |
| 7 | 15 | 1.3 | 0.12 | Tempered color, see through grain of base iron | 60 | 0.5 | 1.4 | Whole reddish brown appearance | Comparative example |

As mentioned above, the present invention can provide insulating films having a good appearance, a good uniformity and excellent adhesion and insulation.

What is claimed is:

1. In a method for forming forsterite insulating film having a high adhesion on an oriented silicon steel sheet, wherein a water slurry containing an annealing separator consisting essentially of magnesia and a CaO impurity, is applied on surfaces of an oriented silicon steel sheet, and then the silicon steel applied with said water slurry is dried, the coated silicon steel sheet is wound up into a coil and annealed at high temperatures to form forsterite films, the improvement comprising adjusting the content (Xg/l m² of both surfaces of the steel sheet) of water carried together with the annealing separator into the coil depending upon the content (Yg/l m² of both surfaces of the steel sheet) of CaO carried into the coil so as to satisfy the following formula $$(1.25X)^2+(10Y)^2 \leqq 1.$$

2. The method as claimed in claim 1, wherein the content of water carried into the coil together with the annealing separator is not more than 0.7 g/m² (both surfaces).

3. The method as claimed in claim 1, wherein the content of CaO carried into the coil together with the annealing separator is not more than 0.08 g/m² (both surfaces).

* * * * *